US008121297B2

(12) United States Patent
Katayama et al.

(10) Patent No.: US 8,121,297 B2
(45) Date of Patent: Feb. 21, 2012

(54) SIGNAL PROCESSING DEVICE AND SOUND IMAGE ORIENTATION APPARATUS

(75) Inventors: Masaki Katayama, Hamamatsu (JP); Kenichiro Takeshita, Hamamatsu (JP); Katsuhiko Masuda, Fujieda (JP)

(73) Assignee: Yamaha Corporation, Hamamatsu-shi (JP)

( * ) Notice: Subject to any disclaimer, the term of this patent is extended or adjusted under 35 U.S.C. 154(b) by 1310 days.

(21) Appl. No.: 11/545,402

(22) Filed: Oct. 10, 2006

(65) Prior Publication Data

US 2007/0092085 A1 Apr. 26, 2007

(30) Foreign Application Priority Data

Oct. 11, 2005 (JP) ..... 2005-296261

(51) Int. Cl.
*H04R 5/00* (2006.01)
*H04R 5/02* (2006.01)
*H03G 5/00* (2006.01)

(52) U.S. Cl. ..... 381/17; 381/18; 381/309; 381/310; 381/103; 381/98

(58) Field of Classification Search ..... 381/103, 381/94.1, 94.3, 94.5, 94.8, 17–19, 309–310, 381/98
See application file for complete search history.

(56) References Cited

U.S. PATENT DOCUMENTS

| | | | | |
|---|---|---|---|---|
| 4,136,260 | A | 1/1979 | Asahi | |
| 2004/0062402 | A1 | 4/2004 | Fujita | |
| 2004/0264717 | A1 | 12/2004 | Fujita | |
| 2004/0264718 | A1 * | 12/2004 | Arai | 381/309 |
| 2005/0117757 | A1 * | 6/2005 | Okimoto et al. | 381/102 |
| 2005/0190930 | A1 * | 9/2005 | Desiderio | 381/103 |
| 2006/0083394 | A1 * | 4/2006 | McGrath | 381/309 |

FOREIGN PATENT DOCUMENTS

| | | |
|---|---|---|
| JP | A-52-141601 | 11/1977 |
| JP | 06-178398 | 6/1994 |
| JP | A-09-135499 | 5/1997 |
| JP | 2001-086599 | 3/2001 |
| JP | A-2004-056418 | 2/2004 |
| JP | A-2004-361573 | 12/2004 |

OTHER PUBLICATIONS

Japan Patent Office "Notice of Reason for Refusal" dated Aug. 9, 2010, Application No. 2005-296261 of Yamaha Corporation, 4 pages.

* cited by examiner

*Primary Examiner* — Devona Faulk
*Assistant Examiner* — George Monikang
(74) *Attorney, Agent, or Firm* — Pillsbury Winthrop Shaw Pittman LLP

(57) ABSTRACT

A signal processing device includes a filter that is set to frequency characteristics in which a dip existing in an intermediate and high frequency range is smoothed in the frequency characteristics of a virtual characteristic applying filter for applying transfer characteristics of a space transfer path to a sound signal, the space transfer path extending from a virtually set orientation of a sound image to an ear of a listener, an equalizer that forms the dip by cutting a part of the intermediate and high frequency range, and an adjusting unit that adjusts at least a central frequency of the dip. An input signal is passed through the filter and the equalizer.

6 Claims, 4 Drawing Sheets

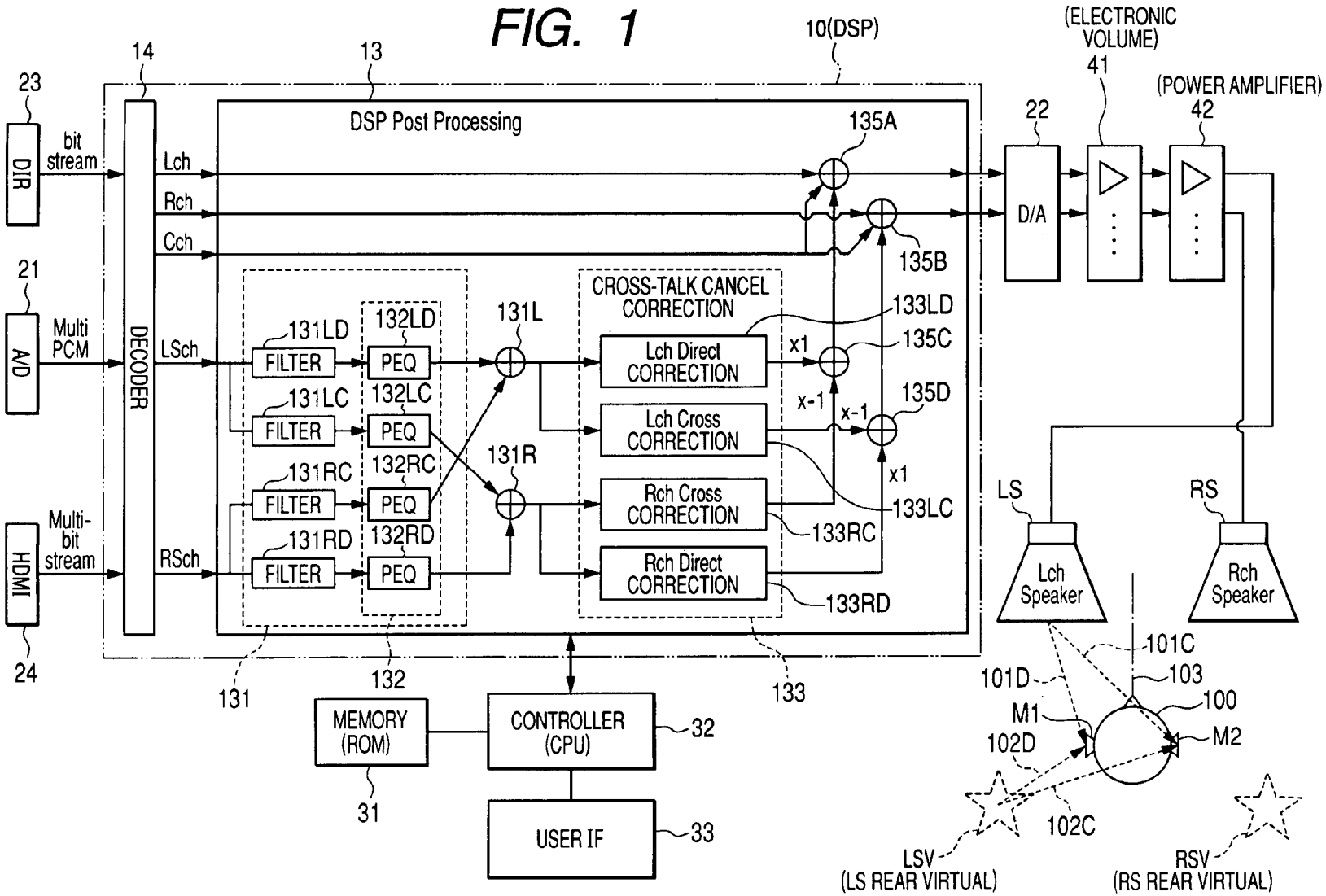
FIG. 1
10(DSP)
13
DSP Post Processing
14
DECODER
Lch
Rch
Cch
LSch
RSch
bit stream
Multi PCM
Multi-bit stream
23
DIR
21
A/D
24
HDMI
22
D/A
41
(ELECTRONIC VOLUME)
42
(POWER AMPLIFIER)
135A
135B
135C
135D
133LD
133LC
133RC
133RD
x1
x-1
CROSS-TALK CANCEL CORRECTION
Lch Direct CORRECTION
Lch Cross CORRECTION
Rch Cross CORRECTION
Rch Direct CORRECTION
133
131L
131R
132LD
132LC
132RC
132RD
PEQ
132
131LD
131LC
131RC
131RD
FILTER
131
32
CONTROLLER (CPU)
33
USER IF
MEMORY (ROM)
31
Rch Speaker
Lch Speaker
RS
LS
101C
103
100
M2
101D
M1
102D
102C
RSV (RS REAR VIRTUAL)
LSV (LS REAR VIRTUAL)

HEAD TRANSFER FUNCTION IN DIRECT DIRECTION WHEN
A SOUND SOURCE IS PROVIDED IN A REAR PART
(AT 115 DEGREES FROM A FRONT PART)

HEAD TRANSFER FUNCTION IN CROSSING DIRECTION WHEN
A SOUND SOURCE IS PROVIDED IN A REAR PART
(AT 115 DEGREES FROM A FRONT PART)

FIG. 3A

HEAD TRANSFER FUNCTION PROCESSED BY FILTER FOR SMOOTHING THE DIP OF HIGH FREQUENCY IN FIG. 2(A)

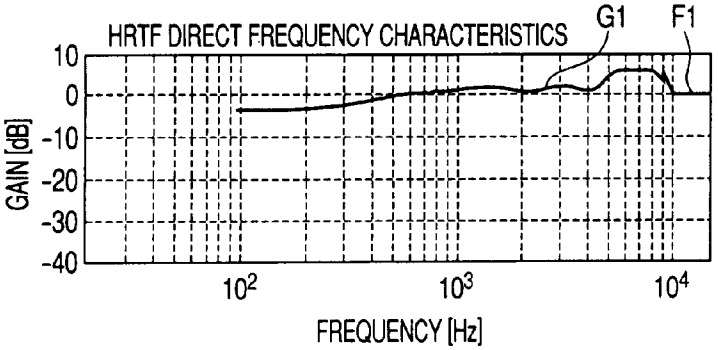

FIG. 3B

HEAD TRANSFER FUNCTION PROCESSED BY FILTER FOR SMOOTHING THE DIP OF HIGH FREQUENCY IN FIG. 2(B)

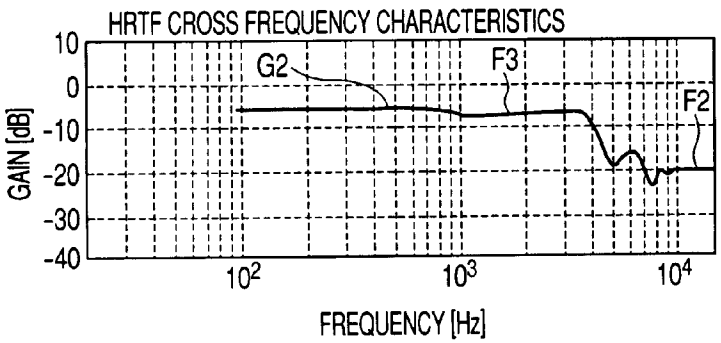

FIG. 3C

HEAD TRANSFER FUNCTION PROCESSED BY FILTER FOR ADDING DIP IN AN INTERMEDIATE AND HIGH FREQUENCY PART OF FIG. 3(A)

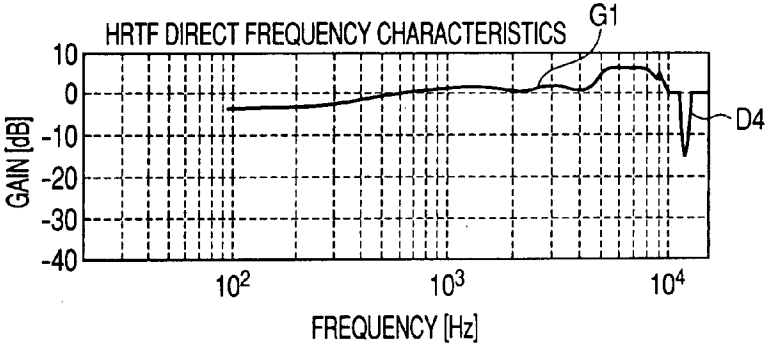

FIG. 3D

HEAD TRANSFER FUNCTION PROCESSED BY FILTER FOR ADDING DIP IN AN INTERMEDIATE AND HIGH FREQUENCY PART OF FIG. 3(B)

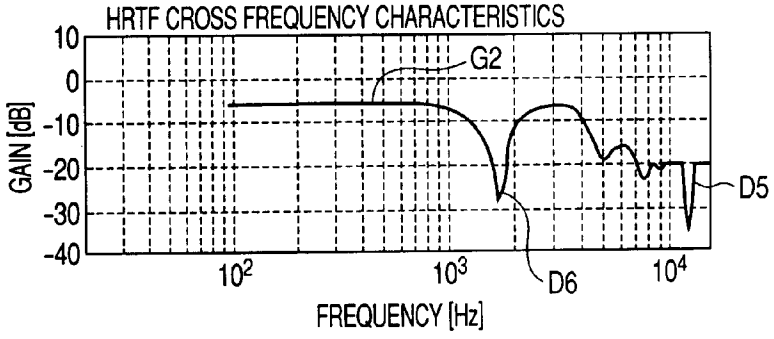

ADJUSTMENT OF CENTRAL FREQUENCY OF DIP

ADJUSTMENT OF DIP GAIN

ADJUSTMENT OF WIDTH OF DIP

ADJUSTING PANEL

SIGNAL PROCESSING DEVICE AND SOUND IMAGE ORIENTATION APPARATUS

BACKGROUND OF THE INVENTION

The present invention relates to a sound image orientation apparatus having a cross-talk cancel and correcting function and forming a sound field on the basis thereon.

Usually, a spatial propagation from a virtual sound source to the ear of a listener is modeled to add such an acoustic effect to which the virtual sound source is oriented (for instance, see Patent Documents 1 to 3).

A sound image orientation apparatus having a cross-talk cancel function has been hitherto disclosed (for instance, see, Patent Document 1.). A component reaching from a right speaker to the left ear or vice versa is referred to as a cross-talk and a function for canceling the cross-talk is referred to as a cross-talk cancel. The cross-talk cancel means a technique that enables the left side ear to hear only the sound of a left side speaker and the right side ear to hear only the sound of the right side speaker and eliminates the orientation of the speakers themselves. In this technique, the spatial propagation from the sound source to the ear of the listener is modeled and such a sound wave as to cancel the cross-talk at the spot of the ear of the listener is processed to a digital sound source to be sounded in accordance with a calculation by an inverse matrix. Then, for instance, when a front floor type speaker is used and a rear model head transfer function is used to orient a sound image from a rear side or to form a free sound field, the cross-talk cancel is necessary for exhibiting its effect.

In the Patent Document 1, a stereo acoustic device or the like is disclosed in which the cross-talk cancel is carried out or the sound field is formed by employing a result obtained by previously measuring the model head transfer function measured by using a dummy head.

However, when the cross-talk cancel is carried out or a rear orientation is added by using the model head transfer function, its effective range can be effected only in view of a pin-point or it is disadvantageously affected by a personal difference. Thus, devices of Patent Documents 2 and 3 are disclosed.

In the Patent Document 2, a sound image orientation control method is disclosed in which, since the model head transfer function for a high frequency reproduces peaks or dips in view of frequency characteristics different from those of a listener, when a sound image orientation is realized, unnecessary peaks or dips in view of frequency characteristics are removed for reasons of the generation of an unnatural tone quality.

Further, the patent Document 3 discloses a sound image orientation apparatus mainly using a headphone in which peaks or dips are formed in a predetermined frequency to reproduce a head transfer function. Further, in the Patent Document 3, there is a description that since the central frequency of the peaks or the dips or the optimum value of a half-value width is different respectively to listeners, the central frequency or the half-value width is adjusted so that each listener can most feel a sense of front and rear.

[Patent Document 1] JP-A-2001-86599

[Patent Document 2] JP-A-6-178398

[Patent Document 3] JP-A-2003-153398

However, as in the Patent Document 2, when the peaks or the dips of the high frequency are removed as unnecessary parts, a problem arises that a sound image effect is actually insufficient. On the other hand, when the peaks and the dips are left as they are, a problem arises that a tone quality is unnatural and sound may be sometimes hardly heard due to a personal difference or a deviation from a position supposed to be effected by a model head transfer function.

Further, as described above, in the Patent Document 3, though there is a description that the central frequency or the half-value width is adjusted so that each listener can most feel the sense of before and after. However, since the peaks and dips are added to a diffusing filter simulating a single ear spectrum, it may not be necessarily said that the device disclosed in the Patent Document 3 represents the head transfer function.

SUMMARY OF THE INVENTION

Thus, it is an object of the present invention to provide a sound image orientation apparatus solving a problem that a tone quality is unnatural and sound may be sometimes hardly heard due to a personal difference or a deviation from a position supposed to be effected by a model head transfer function.

In the present invention, units for solving the above-described problems are constructed as described below.

(1) The present invention provides a signal processing device comprising: a filter that is set to frequency characteristics in which a dip existing in an intermediate and high frequency range is smoothed in the frequency characteristics of a virtual characteristic applying filter for applying transfer characteristics of a space transfer path to a sound signal, the space transfer path extending from a virtually set orientation of a sound image to an ear of a listener; an equalizer that forms the dip by cutting a part of the intermediate and high frequency range; and an adjusting unit that adjusts at least a central frequency of the dip. An input signal is passed through the filter and the equalizer.

Preferably, the intermediate and high frequency range is from 1 kHz to 20 kHz.

According to such a construction, since the dip existing in 1 kHz to 20 kHz in the frequency characteristics of the virtual characteristic applying filter is smoothed, and the signal is processed by using the smoothed dip. Therefore, a factor, in which the tone quality to which virtual characteristics are given is unnatural or sound is hardly heard, is cancelled since a signal processing is performed by using the above smoothing. When the dip is deleted in such a way, a sound orientation is insufficient. Accordingly, in the present invention, a dip part is newly added and the dip part can be adjusted by the adjusting unit. Thus, not only a problem that the tone quality is unnatural is solved, but also such a signal processing operation as to realize an adequate sound image orientation can be carried out to meet an individual head transfer function or a deviation from a supposed position.

(2) The present invention provides a sound image orientation apparatus comprising: the signal processing device according to above (1); and a cross-talk cancel filter that cancels transfer characteristics of a space propagation path from a position of an actual speaker to the ear of the listener from a signal which is passed through the device.

For instance, when not a headphone, but a floor speaker is used, the virtual characteristic giving filter having the structure described in (1) is supposed to pass through the cross-talk cancel filter. According to the present invention, in the sound image orientation apparatus passing through the cross-talk cancel filter, the effects of (1) can be achieved. That is, in the present invention, according to the structure described in (1), since the dip part can be adjusted by the adjusting unit, not only a problem that the tone quality is unnatural is solved, but also the effect of a sound image orientation can be adequately exhibited to meet an individual head transfer function or a deviation from a supposed position.

According to the present invention, not only a problem that the tone quality is unnatural is solved, but also an adequate sound image orientation can be realized to meet an individual head transfer function or a deviation from a supposed position.

BRIEF DESCRIPTION OF THE DRAWINGS

The above objects and advantages of the present invention will become more apparent by describing in detail preferred exemplary embodiments thereof with reference to the accompanying drawings, wherein:

FIG. 1 shows a structure of a sound image orientation apparatus according to an embodiment;

FIGS. 3A to 3D show conceptual views of the operation of a filter PEQ connected to a filter of the virtual orienting addition of the sound image orientation apparatus according to the embodiment.

DETAILED DESCRIPTION OF THE PREFERRED EMBODIMENTS

Figure 2A:
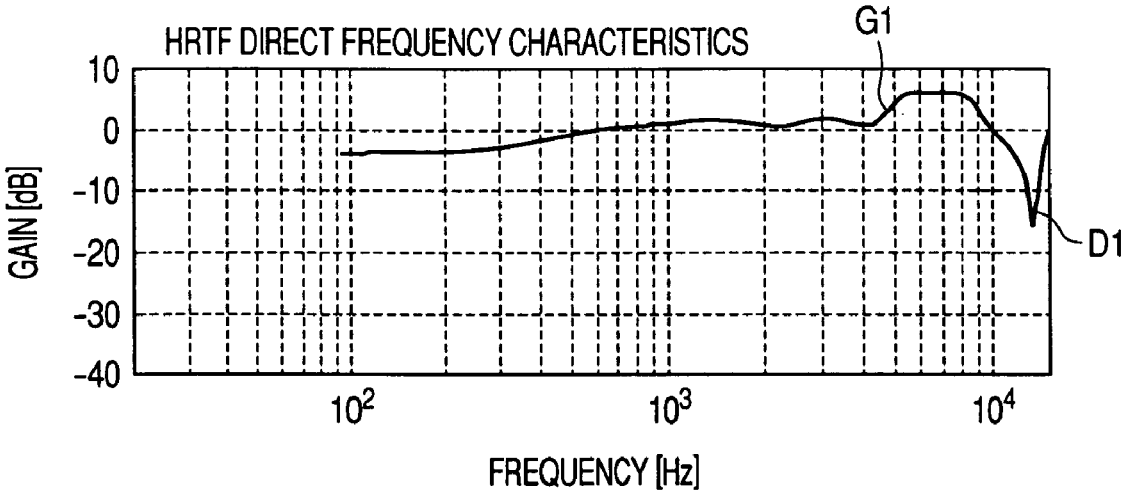
FIGS. 2A and 2B show gain diagrams of a model head transfer function used for a rear orienting addition 131 of the sound image orientation apparatus according to the embodiment.

Now, a sound image orientation apparatus of this embodiment will be described below by referring to FIG. 1. FIG. 1 shows the structure of the sound image orientation apparatus according this embodiment during a reproduction thereof.

A summary of the structure of the sound image orientation apparatus will be briefly described below. Namely, a digital sound signal of input parts 23, 21, and 24 is fetched and the signal is digitally processed by a DSP 10. The digital sound signal is converted into an analog sound signal by a D/A converter 22. A sound volume is adjusted by an electronic volume 41. The analog sound signal is outputted to an Lch speaker LS and an Rch speaker RS by a power amplifier 42 to generate a sound.

Further, the summary of a function of the sound image orientation apparatus of this embodiment will be described in a single word. Sound signals of 5 ch including an Lch, an Rch, a Cch, an LSch and an RSch as shown in FIG. 1 are mixed down to create a sound image orientation as if the speakers of the LSch and the RSch were actually present in rear parts in actually existing front speakers Ls and RS of 2 ch.

Further, units of the sound image orientation will be briefly described below. Namely, in the DSP 10, to digital sound source data of the 5 ch, the acoustic effects of rear orienting additions 131 LD to 131 RD are added by using a head transfer function (a detail is described below) from a rear part to the ear of a human being. Then, a cross-talk cancel (a detail is described below) for realizing the actual effect of the acoustic effects is employed to process the sound source of the 5 ch and output a sound from the actually existing speakers LS and RS.

However, the above-described summaries do not limit the present invention and other structures may be provided.

Now, the structures will be described in order below.

Initially, signal input parts shown in FIG. 1 include a digital interface represented by a DIR 23, an A/D converter 21 and an HDMI 24 (a registered trademark, the following the same) (however, these members are not necessarily required to form the device of this embodiment, and further, another input system may be provided). All the signal input parts can input the data of the 5 ch. That is, the 5 ch designates digital sound inputs outputted to the speakers of the Lch (a leftward front), the R ch (a rightward front), the C ch (a center and front), the LS ch (a rearward left) and the RS ch (a rearward right). The L ch designates the output of the actually existing speaker in a leftward front side. The Rch designates the output of the actually existing speaker in a rightward front side. The C ch does not actually exist in the device of this embodiment and is a virtual input. As shown in the DSP 10 in FIG. 1, in the device of this embodiment, the digital sound inputs or data may be divided into the L ch and the R ch and simply synthesized and outputted. Otherwise, information having a sense of forward distance may be given to the digital sound inputs. The LS ch and the RS ch designate sound inputs to the rear speakers. However, in the device of this embodiment, the Ls ch and the Rs ch are virtual ch, and accordingly, they undergo a signal processing in the DSP 10 to be synthesized with the L ch and the R ch. Since a viewing and listening environment is restricted, the speakers of the 5 ch are arranged. In the device of this embodiment, the above-described model head transfer function is used to create a rearward acoustic effect of an output and compensate for a virtual output.

The DIR 24 can input the digital time series sound data of a bit stream.

The A/D converter 21 can convert an analog signal, for instance, a sound signal inputted from a microphone to digital time series data and transmits the data to a decoder 14.

The HDMI 23 (High-Definition Multimedia Interface) collectively receives sound and control signals.

The DSP 10 includes a post-processing DSP 13 and the decoder 14. The DSP 10 processes the digital time series data inputted from the above-described input parts and sends the data to the D/A converter 22.

The D/A converter 22 includes a S/A converting IC capable of outputting two systems or two D/A converting ICs or an IC chip including the function. The D/A converter 22 converts the data generated by the DSP 10 into the analog signal. The analog signal is converted to a sound by the speakers LS and Rs through the electronic volume 41 for adjusting the sound volume and the power amplifier.

The power amplifier 42 may be what is called a digital amplifier that amplifies a digital amplitude before the data is converted to the analog signal in the D/A converter, and then, removes a high frequency to obtain the analog signal.

Further, the sound image orientation apparatus includes a controller 32 for controlling the above-described construction, a memory 31 for storing the control data of the controller 32 and a user interface 33 for instructing the controller 32. The memory 31 stores the model head transfer function as data tables respectively for both ears from the directions where the speakers are present to the ears. The head transfer function indicates a transfer function simulating a spatial propagation to the ear from a prescribed direction and the head transfer function already formed as a data base is currently known. This head transfer function is used so that the sound image orientation as if a rearward sound were sounded can be added.

Now, by referring to the same FIG. 1, the DSP 10 will be described in more detail. The DSP 10 includes the decoder 14 and the post-processing DSP 13, which will be respectively described below.

The decoder 14 decodes the digital time series data inputted from the DIR 23, the A/D converter 21 and the HDMI 24 as the above-described input parts and sends the data to the post-processing DSP 13. As described above, the decoder 14 itself can treat the sound data of the 5 ch as the digital time series data. That is, the 5 ch designates the digital sound inputs outputted to the speakers of the Lch (a leftward front), the R ch (a rightward front), the C ch (a center and front), the LS ch (a rearward left) and the RS ch (a rearward right).

The post-processing DSP 13 performs a signal process of the sound data of the 5 ch to mix down the sound data to the data of the 2 ch and outputs a dummy 5 ch signal.

To mix down the sound data as shown in FIG. 1, in a system of this embodiment, the C ch is firstly divided into the L ch and the R ch, respectively, and adders 135A and 135B are respectively added to the signals of the L ch and the R ch. Further, when the sound data is mixed down as described above, the LS ch (the rearward left) and the RS ch (the rearward right) need to be virtually heard from the rear parts, so that a rear orienting addition 131 (including a PEQ 132.) and a cross-talk cancel correcting circuit 133 are provided. Then, as shown in FIG. 1, the data of the LS ch (the rearward left) and the RS ch (the rearward right) is processed and added to the Lch and the Rch.

The rear orienting addition 131 as shown in FIG. 1 creates a pseudo effect as if the sound were heard from the rear part. Now, a method for creating the pseudo effect will be described below. The PEQ 132 included in the rear orienting addition 131 will be described below in FIGS. 3A to 3D. Here, for making an explanation easy, the rear orienting addition 131 is described as a member having no PEQ. Further, for making the explanation of the rear orienting addition 131 easy, it is assumed that an LS rear virtual speaker LSV and an RS rear virtual speaker RSV as shown in the right part of FIG. 1 are actually present and the sound itself of the LS ch and the RS ch are generated from the speakers LSV and RSV. Under such an assumption, the sound of the LS ch enters a left ear M1 via a rear direct direction 102D and transmitted to a right ear M2 via a rearward crossing direction 102C. To simulate the spatial transfer, filters 131 LD and 131 LC respectively use the model head transfer functions of the paths of 102D and 102C. The LS ch is described above. The sound of the RS ch forms a linear symmetry, for the purpose of explanation, with respect to the line of the direction 103 of the face of a listener (as for a positional relation, especially, the angle of the virtual speakers viewed from a front part may not be linearly symmetrical) and has the same explanation as described above.

The filter function of the rear orienting addition 131 shown in FIG. 1 is summarized as described below.

A filter 131 LD uses a model head transfer function from the LS rear virtual speaker LSV to the left ear M1.

A filter 131 LC uses a model head transfer function from the LS rear virtual speaker LSV to the right ear M2.

A filter 131 RD uses a model head transfer function from the RS rear virtual speaker RSV to the right ear M2.

A filter 131 RC uses a model head transfer function from the RS rear virtual speaker RSV to the left ear M1.

Then, in the rear orienting addition 131, these filters are convoluted in the LS ch and the RS ch to add the acoustic characteristics of the rear virtual speakers LSV and RSV thereto.

Now, the cross-talk cancel correcting circuit 133 shown in FIG. 1 will be described below. The purpose of the correcting circuit 133 is to send the characteristics of the model head transfer function formed in the rear orienting addition 131 to both the ears. If the sound of LS rear orientation calculating parts 131L and 131R is listened to by an ideal headphone, the characteristics of the model head transfer function can be sent to both the ears (however, since the headphone has characteristics having many peaks and dips, the above-described purpose is not necessarily achieved.).

However, in the device of this embodiment using a loud speaker, since the sound is listened to from the front speakers RS and LS, there is a fear that an acoustic wave is deformed by the spatial transfer from the front speakers RS and LS to both the ears during the spatial transfer of the acoustic wave so that the effect of the above-described LS rear orienting addition cannot be sufficiently exhibited.

Thus, the sound source outputted from the actual speakers existing in the front parts is processed so that the output of the LS rear orientation calculating part 131L falsely enters only the left ear and the output of the RS rear orientation calculating part 131R falsely enters only the right ear. A method for obtaining filter factors of the filters of the cross-talk cancel correcting circuit 133 will be complementally described below.

Now, the concept of the operation of the PEQ 132 (parametric equalizer) included in the rear orienting addition 131 described in the explanation of FIG. 1 will be described by referring to FIGS. 2A to 4D.

Figure 2B:
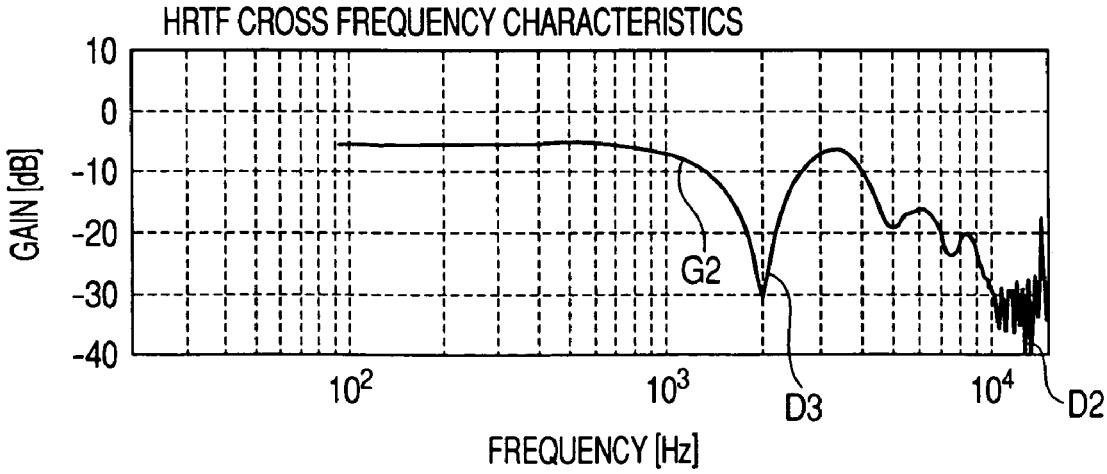

Firstly, by referring to FIGS. 2A and 2B, the filters of the rear orienting addition 131 will be specifically described. FIGS. 2A and 2B are gain diagrams of the model head transfer function used in the rear orienting addition 131 of the sound image orientation apparatus of this embodiment.

FIG. 2A shows a model head transfer function G1 from a direction to the left ear, when it is assumed that the direction is changed leftward by 115 degrees to a rear part from the direction 103 of the face of the listener shown in FIG. 1 and the speaker is provided in a horizontal direction. This model head transfer function is used in the filter 131 LD shown in the explanation of FIG. 1.

FIG. 2B shows a model head transfer function G2 from a direction to the right ear M2, similarly when it is assumed that the direction is changed leftward by 115 degrees to a rear part from the direction 103 of the face of the listener shown in FIG. 1 and the speaker is provided in the horizontal direction. This model head transfer function is used in the filter 131LC shown in the explanation of FIG. 1.

As shown in FIGS. 2A and 2B, the model head transfer function G2 in the crossing direction has a gain smaller than that of the transfer function G1 in the direct direction. This phenomenon is estimated to result from the decrease of a gain due to the difference of propagated distance owing to the difference in position of both the ears and a diffraction by the face or the like.

The model head transfer functions G1 and G2 shown in FIGS. 2A and 2B are similarly and linearly symmetrical with respect to the direction 103 of the face of the listener (see FIG. 1) for the purpose explanation (the positional relation may not indicate the linear symmetry). Accordingly, in the following description, the model head transfer function of the L ch is used for the explanation. That is, since the filter 131 LD and the filter 131 RD shown in FIG. 1 are similar to each other and the filter 131 LC is similar to the filter 131 RC, the explanation of the L ch is used for the explanation of the filter 131 RD and the filter 131 RC.

Now, by referring to FIGS. 2A and 2B, the influence of the head transfer function on an acoustic sense will be described below. It is said that 1 kHz or lower of the frequency [Hz] of the head transfer function is perceived as a phase difference and 1 kHz to 7 kHz of the frequency [Hz] is perceived as a gain and a sense of sound volume. In the range of 1 kHz to 7 kHz, the head transfer function rarely has a personal difference. Accordingly, the dip D3 shown in FIG. 2B is said to hardly have a relation to the personal difference. Further, as shown in FIG. 2B, the dip D3 appears in the model head transfer function simulating the propagation characteristics in the crossing direction and has a small gain. However, according to the experiment of the inventor, it was found that the dip D3 in this frequency range greatly gives an influence on the sound image orientation.

On the other hand, when the frequency of the head transfer function is not lower than 7 kHz, it is said that since the configurations of the faces are respectively individually different, in the head transfer function, dips that are generated owing to the interference of the sound by the configuration of the faces have respectively different frequencies and configurations depending on individuals (see dips D1 and D2 shown in FIGS. 2A and 2B).

As described above, the model head transfer functions G1 and G2 of the rear orienting addition 131 as shown in FIGS. 2A and 2B are individually different. Especially, the configurations of the dips located within a range of 1 kHz to 20 kHz of the model head transfer functions G1 and G2 give a great influence on the sound image orientation. Accordingly, even when the filters of the rear orienting addition 131 are formed in accordance with a measure result using a dummy head, the filters are not sufficiently effectively applied to the individuals having different configurations from that of the dummy head. Further, the dips may sometimes cause the individuals to be tired with listening to the sound. In the device of this embodiment, an adjustment that meets such a personal difference is carried out by using the PEQ 132 shown in FIG. 1 as described below.

Now, referring to FIGS. 3A to 3D, the PEQ 132 (see FIG. 1) of the device of this embodiment will be described below. FIGS. 3A to 3D is a conceptual diagram of the PEQ 132. Though not clearly shown in FIG. 1, the PEQ 132 is composed of the filters of two stages connected in series.

The first filter of the PEQ 132 is a filter connected in series to the rear orienting addition 131 to smooth the dips D1 and D2 of the rear orienting addition 131 shown in FIGS. 2A and 2B. Smoothing parts F1, F2 and F3 shown in FIGS. 3A and 3B are provided to process the model head transfer functions G1 and G2 shown in FIGS. 2A and 2B. Specifically, the smoothing parts are filters for smoothing the band of 1 kHz to 20 kHz. The first filter is connected to the rear orienting addition to cancel tiredness with listening to the sound.

FIG. 3B shows a model head transfer function in which the dip D3 in the G2 shown in FIG. 2B is embedded and smoothed. However, a flat gain and a delay may be used in this band to form the first filter.

However, as shown in FIGS. 3A and 3B, when the dips are removed, the orientation is not accurately fixed as in the Patent Document 2, and what is called, the listener receives an absent-minded feeling in view of an acoustic sense.

Thus, in the device of this embodiment, as shown in FIGS. 3C and 3D, a second filter is provided in the PEQ 132 to perform such a signal processing as to add dips D4, D5 and D6 again. The dips are not merely added by restoring the dips, but added by using an adjusting method and an adjusting device explained in a below-description shown in FIGS. 4A to 4D.

As an actual mounting form, it is not desirable that the rear orienting addition 131 shown in FIG. 1 and the first filter for removing the dips as described in FIGS. 3A and 3B are separately provided and calculated during processing a signal. It is desirable in view of calculation and simplification of the device that the rear orienting addition 131 and the first filter are previously calculated together and stored in the memory 31 or an external storage device not illustrated as the filter factors at the time of shipment of the device from a factory. For instance, as the filter factor of the rear orienting addition 131 described by using the above-described formula, a specific angle of a prescribed speaker and the direction 103 (see the right part in FIG. 1) of the face of the listener is previously assumed to prepare one pattern during the shipment of the device of this embodiment from the factory. Thus, a filter having frequency characteristics in which the dips located in 1 kHz to 10 kHz or higher than 10 kHz are previously flattened as shown in FIGS. 3A and 3B can be prepared for a frequency characteristic filter as a virtual characteristic giving filter as a parameter.

On the other hand, the second filter as shown in FIGS. 3C and 3D needs to meet the listener as described below with reference to FIGS. 4A to 4D. Accordingly, the second filter cannot be previously prepared at the time of the shipment of the device from the factory. As an actual mounting form, the PEQ 132 forms an equalizer that only performs such a signal processing as to add the dips D4, D5 and D6 as shown in FIGS. 3C and 3D.

Now, by referring to FIG. 4A to 4D, a method will be described for adjusting the dips added again in the device of this embodiment as shown in FIGS. 3C and 3D. FIGS. 4A to 4D are conceptual diagrams showing how the dips are adjusted when the dips are added. As described above, when the dips are merely added as shown in FIGS. 3C and 3D, the personal difference is not met so that the listener is tired with listening the sound. Accordingly, in the device of this embodiment, the adjusting device is provided to perform an adjustment for meeting the personal difference.

Figure 4A:
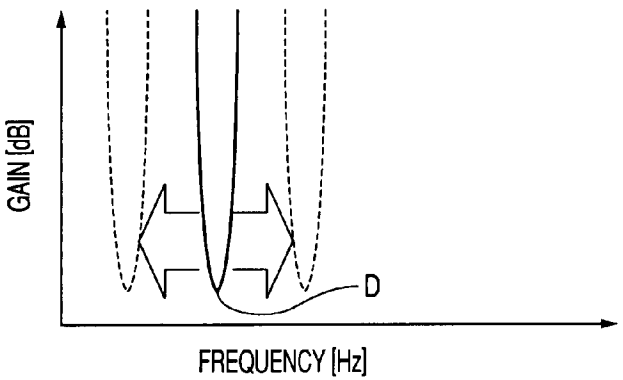
FIGS. 4A to 4D show diagrams showing an adjusting method of the filter of the virtual orienting addition of the sound image orientation apparatus according to the embodiment.

FIG. 4A is a conceptual diagram for adjusting the central frequency of a dip part. As shown in this drawing, the dip D is moved in the directions shown by both arrow marks so as to have forms shown by broken lines to adjust a frequency. As the frequency, default values are set to around the frequencies of the smoothed parts F1, F2 and F3 (F1 and F2 are located within 7 kHz to 20 kHz and F3 is located within 1 kHz to 3 kHz) shown in FIGS. 3A and 3B to adjust the frequency of the dip by 20% upward and downward.

Figure 4B:
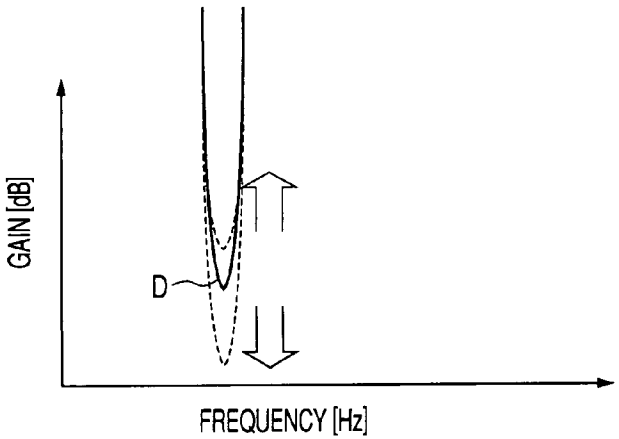

FIG. 4B is a conceptual diagram showing an adjusting method of the gain of the dip part. As shown in this drawing, the dip D is moved in the directions shown by both arrow marks so as to have forms shown by broken lines to adjust the gain of the dip part.

Figure 4C:
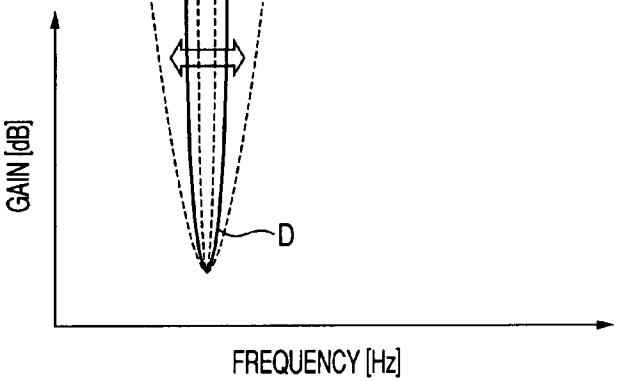

FIG. 4C is a conceptual diagram showing an adjusting method of the width or the Q value of the dip part. As shown in this drawing, the dip D is moved in the directions shown by both arrow marks, that is, the width of the dip is changed so as to show forms by broken lines to adjust the form of the dip part. The Q value means the width of a dip form located at a position ascending by 3 dB from the top of the dip D.

Figure 4D:
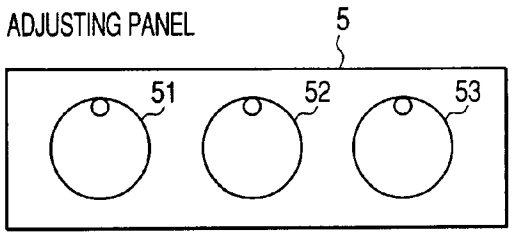

FIG. 4D shows an example of an adjusting panel for performing adjustments shown in FIGS. 4A to 4C. The adjusting panel includes a frequency adjusting thumb 51, a gain adjusting thumb 52 and a Q value adjusting thumb 53. These thumbs are circular rotating type thumbs. The listener rotates the thumbs so that the rear orienting addition 131 can be rotated to the directions shown in FIGS. 4A to 4C. The adjusting panel needs six adjusting devices or functions to meet the six adjustments of the PEQ 132 (D3 to D6 and virtual right and left 2ch) as shown in FIG. 1.

The speakers are laterally symmetrically arranged to make 132 LD equal to 132 RD and 132 LC equal to 132 RC so that the adjusting devices or functions may be saved to three. Further, as another method for saving the adjustment, a simple structure may be considered in which one thumbs 51 to 53 shown in FIG. 4D are respectively provided and the adjustment of the dips D4, D5 and D6 shown in FIGS. 3C and 3D is interlocked therewith to save or simplify the devices or the functions to two for the right and left ch.

Further, the dip D shown in FIGS. 4A to 4C results from the model head transfer function and the central frequency of the dip D is considered to be caused by the interference of the sound due to the configuration of the face and a range difference of both ears. In the case of the listener having a narrow face, the range difference is small and the central frequency of the dip is large. Accordingly, the adjustment of the frequency adjusting thumb 51 shown in FIG. 4D is interlocked with the adjustment of the dip, so that the adjusting devices or functions may be simplified to two for the right and left ch. Further, the thumbs may be displayed not by the central frequency of the dip D, but by the width of the face.

Referring again to FIGS. 3C and 3D, the dips D4, D5 and D6 will be described below.

As for the dip D4, the dip corresponding to the dip D1 is formed by cutting a part of the frequency relative to the filter (see the frequency characteristics shown in FIG. 3A) for smoothing the dip D1 of the intermediate and high frequency shown in FIG. 2A at the part of F1.

As for the dip D5, the dip corresponding to the dip D2 is formed by cutting a part of the frequency relative to the filter (see the frequency characteristics shown in FIG. 3B) for smoothing the dip D2 of the intermediate and high frequency shown in FIG. 2B at the part of F2.

As for the dip D6, the dip corresponding to the dip D3 is formed by cutting a part of the frequency relative to the filter (see the frequency characteristics shown in FIG. 3B) for smoothing the dip D3 of the intermediate and high frequency shown in FIG. 2B at the part of F3. These dips D4, D5 and D6 are respectively formed not only by reproducing the same dips as the dips D1, D2 and D3, but by adjusting the central frequency, the width and the gain of the dip as described with reference to FIGS. 4A to 4C.

Now, the method for obtaining the filter factors of the cross-talk cancel correcting circuit 133 described with reference to FIG. 1 will be complementally described by referring to FIG. 1 again.

In the cross-talk cancel correcting circuit 133, the model head transfer function is used in which the spatial transfer from the front speakers RS and Ls to both the ears is simulated or actually measured by an experiment. As described above, the model head transfer function is stored in the memory 31 shown in FIG. 1 as the data table. The controller 32 selects the suitable model head transfer functions for four patterns of (the speakers LS and RS) to (the left ear and the right ear) from the data table stored in the memory 31 shown in FIG. 1. Specifically, the controller selects below-described functions and determines them as described below for convenience sake.

The model head transfer function of a path of (the L ch speaker LS to the left ear) is designated by LD(Z).

The model head transfer function of a path of (the L ch speaker LS to the right ear) is designated by LC(Z).

The model head transfer function of a path of (the R ch speaker RS to the left ear) is designated by RC(Z).

The model head transfer function of a path of (the R ch speaker RS to the right ear) is designated by RD(Z). (The model head transfer functions are respectively Z-converted in discrete areas. Z represents a delay. "(Z)" is omitted hereinafter). When the model head transfer functions are defined as described above, the filter factors of the transfer functions LD, LC, RC and RD of an L ch direct correction 133 LD, an L ch cross correction 133 LC, an R ch cross correction 133 RC and R ch direct correction 133 RD can be obtained by performing a calculation as described below.

The model head transfer function of a path of (the L ch speaker LS to the left ear) is designated by LD(Z).

The model head transfer function of a path of (the L ch speaker LS to the right ear) is designated by LC(Z).

Firstly, as the sound listened to by both the ears, since the output itself of the rear orientation calculating part 131L (or 131R) simulating the sound field of the rear virtual speakers LSV and RSV in the rear parts shown in FIG. 1 is transmitted to both the ears, the sound field needs to be formed in such a way as described below.

$$\begin{bmatrix} \text{component of the output of adder} \\ 135C \text{ in sound of the left ear} \\ \text{component of the output of adder} \\ 135D \text{ in sound of the right ear} \end{bmatrix} \approx \begin{bmatrix} \text{output of } LS \text{ rear orientation calculating part } 131L \\ \text{output of } RS \text{ rear orientation calculating part } 131R \end{bmatrix} \quad \text{[formula 1]}$$

In this case, "≈" indicates that when the sound of a left side is converted to an electric signal by a microphone, the sound of the left side is equivalent to the sound of a right side (the following is the same.).

Then, when the outputs of the adders 135C and 135D are deformed by the spatial propagation from the front speakers to both the ears in accordance with an acoustic environment in the periphery of the head and transmitted as described below by using the above-described model head transfer functions LD, LC, RC and RD, the components transmitted to the ears from the rear parts can be modeled.

$$\begin{bmatrix} \text{component of the output of adder} \\ 135C \text{ in sound of the left ear} \\ \text{component of the output of adder} \\ 135D \text{ in sound of the right ear} \end{bmatrix} \approx \begin{bmatrix} LD & RC \\ LD & RD \end{bmatrix} \begin{bmatrix} \text{output of the adder } 135C \\ \text{output of the adder } 135D \end{bmatrix} \quad \text{[formula 2]}$$

Because the sound can be calculated by superposition.

Accordingly, the sound signal to be outputted in the adders 135C and 135D can be expressed as shown below.

$$\begin{bmatrix} \text{output of the} \\ \text{adder } 135C \\ \text{output of the} \\ \text{adder } 135D \end{bmatrix} = \begin{bmatrix} LD & RC \\ LD & RD \end{bmatrix}^{-1} \begin{bmatrix} \text{output of an } LS \text{ rear} \\ \text{orientation calculating part } 131L \\ \text{output of an } RS \text{ rear} \\ \text{orientation calculating part } 131R \end{bmatrix} = \begin{bmatrix} RD & -RC \\ -LC & LD \end{bmatrix} \quad \text{[formula 3]}$$

-continued $$\frac{\begin{bmatrix} \text{output of an } LS \text{ rear} \\ \text{orientation calculating part } 131L \\ \text{output of an } RS \text{ rear} \\ \text{orientation calculating part } 131R \end{bmatrix}}{\det\left(\begin{bmatrix} RD & -RC \\ -LC & LD \end{bmatrix}\right)}$$

$$= \begin{bmatrix} RD & -RC \\ -LC & LD \end{bmatrix}$$

$$\frac{\begin{bmatrix} \text{output of an } LS \text{ rear} \\ \text{orientation calculating part } 131L \\ \text{output of an } RS \text{ rear} \\ \text{orientation calculating part } 131R \end{bmatrix}}{(RD \times LD - RC \times LC)}$$

$$= \begin{bmatrix} RD \times \\ \text{output of } LS \text{ rear} \\ \text{orientation calculating part } 131L - \\ RC \times \\ \text{output of } RS \text{ rear} \\ \text{orientation calculating part } 131R \\ -LC \times \\ \text{output of } LS \text{ rear} \\ \text{orientation calculating part } 131L + \\ LD \times \\ \text{output of } RS \text{ rear} \\ \text{orientation calculating part } 131R \end{bmatrix}$$

As understood from the above explanation, the digital data to be generated in the adders 135C and 135D shown in FIG. 1 is digital data corresponding to the above-described components of the sound of the rear virtual speakers obtained by the formulas. Therefore, the transfer functions of the cross-talk cancel correcting circuit 133 are respectively expressed below.

The transfer function of the *L ch* direct correction is represented by $RD/(RD \times LD - RC \times LC)$.

The transfer function of the *Lch* cross correction is represented by $LC/(RD \times LD - RC \times LC)$.

The transfer function of the *R ch* cross correction is represented by $RC/(RD \times LD - RC \times LC)$.

The transfer function of the *Rch* direct correction is represented by $LD/(RD \times LD - RC \times LC)$.

Here, "x" represents a convolution and data that convolutes the L ch cross correction 133 LC and the R ch cross correction RC is respectively multiplied by −1 and added in the adder 135C.

The digital sound inputs passing the cross-talk cancel correcting circuit 133 and the adders 135C and 135D shown in FIG. 1 are added to the data of the L ch and the R ch in the adders 135A and 135B. Then, the added data is outputted to the D/A converter 22 as the data of 2 ch and converted into the sound by the speakers LS and RS through the electronic volume 41 and the power amplifier.

The above-described calculation of the cross-talk cancel correcting circuit shown in FIG. 1 actually has the large number of taps of time delay, so that the calculation may be sometimes difficult. Thus, as an approximation of a practical range, an inverse function of the model head transfer function in the crossing direction is applied from the direct direction to cancel the influence of the crossing direction (for instance, see the Patent Document 1).

Further, the numeric values shown in the device of this embodiment or the forms of the adjusting panel 5 do not limit the present invention and other structures may be provided.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-296261 filed on Oct. 11, 2005, the contents of which are incorporated herein for reference.

What is claimed is:

1. A signal processing device, comprising: a filter that (is set to frequency characteristics in which—cancelled) smoothes a first dip existing in an intermediate and high frequency range of frequency characteristics of a virtual characteristic applying filter (is smoothed—cancelled), wherein the virtual characteristic applying filter applies transfer characteristics of a space transfer path to a sound signal, and the space transfer path extends from a virtually set orientation of a sound image to an ear of a listener, and wherein smoothing of the first dip lessens a first sound image orientation effect applied by the virtual characteristic applying filter; an equalizer that forms a second dip by cutting a part of the intermediate and high frequency range, wherein formation of the second dip applies a second sound image orientation effect; and an adjusting unit that adjusts at least a central frequency of the second dip formed by the equalizer so that the listener can adjust the second sound image orientation effect, wherein an input signal is passed through the filter and the equalizer.

2. A sound image orientation apparatus, comprising:

the signal processing device according to claim 1; and a cross-talk cancel correcting circuit that cancels transfer characteristics of a space propagation path from a position of an actual speaker to the ear of the listener from a signal which is passed through the device.

3. The signal processing device according to claim 1, wherein the intermediate and high frequency range is from 1 kHz to 20 kHz.

4. The signal processing device according to claim 1, wherein the adjusting unit adjusts a gain of the second dip formed by the equalizer.

5. The signal processing device according to claim 1, wherein the adjusting unit adjust a Q value of the second dip formed by the equalizer.

6. The signal processing device according to claim 1, wherein the equalizer forms the second dips subsequently to when the first dip is smoothed.

* * * * *